US006380677B1

(12) United States Patent
Park et al.

(10) Patent No.: US 6,380,677 B1
(45) Date of Patent: Apr. 30, 2002

(54) PLASMA DISPLAY PANEL ELECTRODE

(75) Inventors: Hun-Gun Park; Hong-Ju Ha, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/353,085

(22) Filed: Jul. 15, 1999

(30) Foreign Application Priority Data

Jul. 16, 1998 (KR) ..... 98-28876
Jul. 16, 1998 (KR) ..... 98-28877
Aug. 13, 1998 (KR) ..... 98-32926

(51) Int. Cl.[7] ..... H01J 17/49
(52) U.S. Cl. ..... 313/585; 313/587
(58) Field of Search ..... 313/585, 586, 313/584, 587; 345/60, 41, 55; 315/169.4

(56) References Cited

U.S. PATENT DOCUMENTS 5,789,862 A * 8/1998 Makino ..... 313/586 X
5,914,563 A * 6/1999 Lee et al. ..... 313/585
6,097,149 A * 8/2000 Miyaji et al. ..... 313/585 X

FOREIGN PATENT DOCUMENTS

| | | |
|---|---|---|
| JP | 59014237 A | 1/1984 |
| JP | 03077238 A | 4/1991 |
| JP | 07105856 | 4/1995 |
| JP | 09115450 | 5/1997 |
| JP | 09160525 | 6/1997 |
| JP | 10334810 | 12/1998 |

* cited by examiner

*Primary Examiner*—Ashok Patel
(74) *Attorney, Agent, or Firm*—Fleshner & Kim, LLP

(57) ABSTRACT

The electrode structure for a PDP is disclosed. The structure includes a discharge pair formed of three electrodes at each pixel in the discharge sustaining electrode, and a scan electrode installed at a center portion of three electrodes, and a common electrode installed at both side of the same, respectively, for thereby minimizing the area of a scan electrode in a state that a discharge characteristic is not decreased, decreasing the capacitance which is required for a discharge, decreasing the entire power consumption and increasing a contrast based on one time discharge amount.

20 Claims, 5 Drawing Sheets

PLASMA DISPLAY PANEL ELECTRODE

BACKGROUND OF THE INVENTION

1. Field of the Invention

The present invention relates to a PDP(Plasma Display Panel), and in particular to a structure for a discharge sustaining electrode which makes it possible to form an image display for a certain time by generating a surface discharge in a certain discharge space when a discharge voltage is supplied in a form of multiple pairs in a display apparatus using a plasma.

2. Description of the Background Art

Generally, a PDP(Plasma Display Panel) is a plane display apparatus which is capable of displaying a motion picture or a still picture using a gas discharge phenomenon and is classified into a 2-electrode type, a 3-electrode type and a 4-electrode type. The 2-electrode type is directed to applying a voltage for an addressing and sustaining operation using 2 electrodes, and the 3-electrode type is directed to a surface discharge type and is switched or sustained based on a voltage applied to an electrode installed at a lateral surface of a discharge cell.

FIGS. 1 through 4 illustrate a conventional 3-electrode surface discharge type PDP as a representative example.

FIG. 1 is a perspective view illustrating separated upper and lower substrates, FIG. 2 is a view illustrating an installation of each electrode, and FIG. 3 is a cross-sectional view illustrating a pixel. FIG. 3 illustrates an upper substrate which is rotated at 90 for explaining a discharge principle.

As shown therein, the conventional 3-electrode surface discharge type PDP includes a front substrate 1 which is a display surface of an image and a back substrate 2 parallely spaced apart from the front substrate 1.

The front substrate 1 includes a pair of discharge sustaining electrodes C and S installed at each pixel in a pair form for sustaining a light emitting operation of cells based on a discharge, a dielectric layer 8 for limiting a discharge current of the sustaining electrodes C and S and insulating the electrodes, and a protection layer 9 formed on the dielectric layer 8 for protecting the sustaining electrodes C and S.

The back substrate 2 includes a partition wall 3 for separating a plurality of discharge spaces, namely, the cells, a plurality of address electrodes A formed in parallel with the partition wall 3 for forming discharge pixels at each portion where the discharge sustaining electrodes C and S are crossed on the front substrate 1, and a phosphorus layer 5 formed on the partition wall 3 and the back substrate 2 in the inner surfaces of each discharge pixel for emitting a visual light for displaying an image.

In addition, the sustaining electrodes C and S formed in pairs are formed of a scan electrode S and a common electrode C. As shown in FIGS. 3 and 4, each electrode includes an ITO electrode 6 formed of a transparent conductive material and a metallic BUS electrode 7 for enhancing a transmissivity and forms a certain distance "a" therebetween. In particular, the ITO electrode 6 forms a surface discharge in a corresponding discharge space when a voltage is supplied, and the BUS electrode 7 which is formed of a low resistance metallic material and is formed on the ITO electrode 6 for preventing a voltage drop due to the resistance of the transparent conductive material when a current is applied.

The light emitting process of a certain pixel in the conventional PDP will be explained as follows.

First, in a certain cell, a discharge start voltage of 150~300V is supplied to the scan electrode S, a discharge is formed between the scan electrode S and the address electrode A for thereby forming a wall electric potential on the inner surface of a corresponding discharge space.

Thereafter, when an address discharge voltage is supplied to the scan electrode S and a corresponding address electrode A, an address discharge is formed between the scan electrode S and the address electrode A.

Namely, an electric field is formed in the interior of the cell, and a small amount of electrons in the discharge gas is accelerated. The thusly accelerated electrons collide with a neutral particle in the gas and are separated into electrons and ions, and the neutral particles are more fast separated into electrons and ions due to another collision between the separated electrons and neutral particles, so that the discharge gas becomes a plasma state and a vacuum ultraviolet rays are generated.

The thusly generated ultraviolet rays excite the phosphorus layer 5 for thereby generating a visual ray, and the thusly generated visual ray is radiated to the outside via the front substrate, so that it is possible to recognize a certain cell light emitting operation, namely, an image display.

When a sustaining discharge voltage of more than 150V is supplied to the common electrode C of the light emitting cell, a sustaining discharge is generated between the scan electrode S and the common electrode C for thereby sustaining a light emitting operation of the cell.

The conventional PDP electrode structure has the following problems.

First, since the scan electrode S is formed of a transparent ITO electrode 6 for preventing a decrease of the transmissivity due to the metallic BUS electrode 7, the entire area is increased for thereby increasing the capacitance of the electrode.

Namely, when the capacitance is increased, more energy is needed compared to the same voltage for activating all cells for thereby decreasing the discharging speed during an initial address discharge and increasing the entire power consumption, so that one time discharge amount is increased, and a contrast is decreased as the dark portion luminance is increased.

Second, since the BUS electrode 7 is positioned at an outer portion of the ITO electrode 6 in the scan electrode S and the common electrode C for minimizing the decrease of the transmissivity of the discharge cells, the distance between the BUS electrodes 7 is increased at each discharge cell, so that the transition time for the sustaining discharge is extended for the address discharge.

Namely, when the transition time for the sustaining discharge is extended, the address discharge time is extended thereby, so that the image display on the display screen takes long time.

In addition, when the discharge speed is decreased during the address discharge, and the discharge time is extended, a small amount of the charged particles generated during the address discharge is used for the sustaining discharge, so that the charged particles are spread into the neighboring cells for thereby causing an erroneous discharge and a color blurring problem on the display screen.

SUMMARY OF THE INVENTION

Accordingly, it is an object of the present invention minimize the area of a scan electrode in a state that a discharge characteristic is not decreased, decrease the capacitance which is required for a discharge, decrease the entire power consumption and increase a contrast based on one time discharge amount.

It is another object of the present invention to implement a short time sustaining discharge by making a metallic BUS electrode close to the scan electrode and the common electrode.

It is still another object of the present invention to prevent an erroneous discharge with other neighboring electrodes when a discharge voltage is applied to the scan electrode and the common electrode.

To achieve the above objects, there is provided an electrode structure for a PDP according to a first embodiment of the present invention which includes a discharge pair formed of three electrodes at each pixel in the discharge sustaining electrode, and a scan electrode installed at a center portion of three electrodes, and a common electrode installed at both side of the same, respectively, wherein the PDP includes two engaged substrates having a discharge space therebetween, a discharge sustaining electrode arranged on one side of the substrates for forming a plurality of discharge pairs, and an address electrode arranged on the other side of the substrates for forming a discharge pixel at a portion in which the discharge sustaining electrode and the address electrode are crossed.

To achieve the above objects, there is provided a structure of an electrode for a PDP(Plasma Display Panel) according to a second embodiment of the present invention which includes two engaged substrates engaged for forming a discharge space therebetween, a discharge sustaining electrode parallely arranged on one side of the substrates wherein a scan electrode and a common electrode form a discharge pair at each pixel, an address electrode arranged on the other side of the substrates at a portion in which the discharge electrode and the address electrode are crossed, and the scan electrode being formed of a metallic material.

To achieve the above objects, there is provided an electrode structure for a PDP according to a third embodiment of the present invention which includes each metallic electrode being formed along a portion near the sustaining electrode which forms a discharge pair, wherein the PDP includes two engaged substrates which form a discharge space therebetween, a plurality of discharge sustaining electrodes arranged on one side of the substrates in a pair form by two at each pixel, each of said discharge sustaining electrode being formed of a transparent electrode and a metallic electrode, and an address electrode arranged on the other side of the substrate for forming a discharge pixel at a portion in which the discharge sustaining electrode and the address electrode are crossed.

The common electrode is formed of a transparent conductive material ITO electrode and a metallic BUS electrode.

The scan electrode is formed of a metallic BUS electrode.

Both ends of each of the common electrodes are connected each other.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
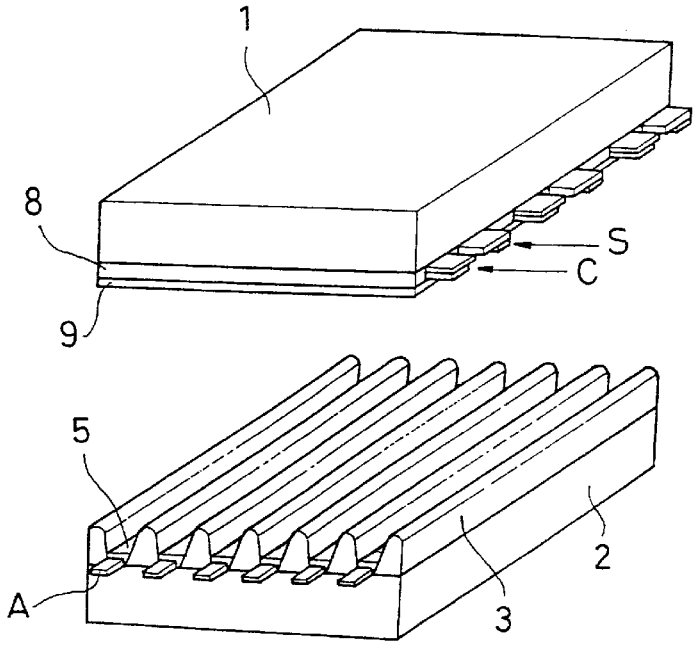
FIG. 1 is a perspective view illustrating upper and lower substrates of a conventional 3-electrode surface discharge type PDP.
Figure 2:
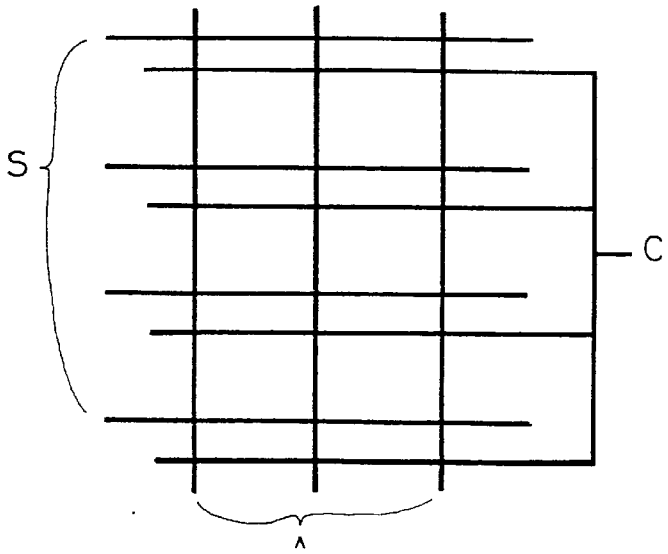
FIG. 2 is a view illustrating an electrode installation of the conventional PDP.

The embodiments of the present invention will be explained with reference to the accompanying drawings.

In the drawings, the same elements as the conventional art are given the same reference numerals, and the descriptions thereof are omitted.

Figure 5:
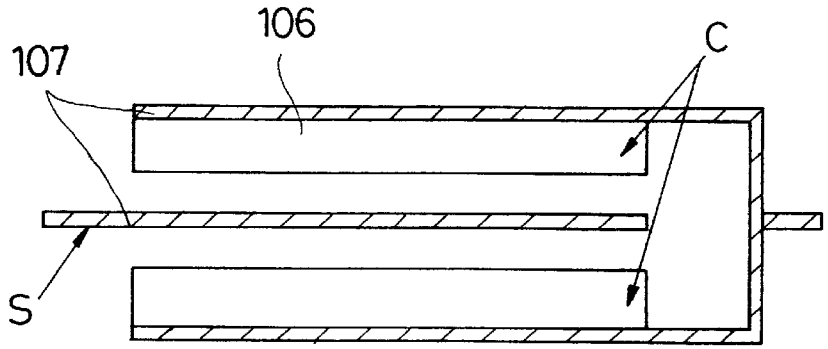
FIG. 5 is a plan view illustrating a structure of an electrode according to a first embodiment of the present invention.
Figure 6:
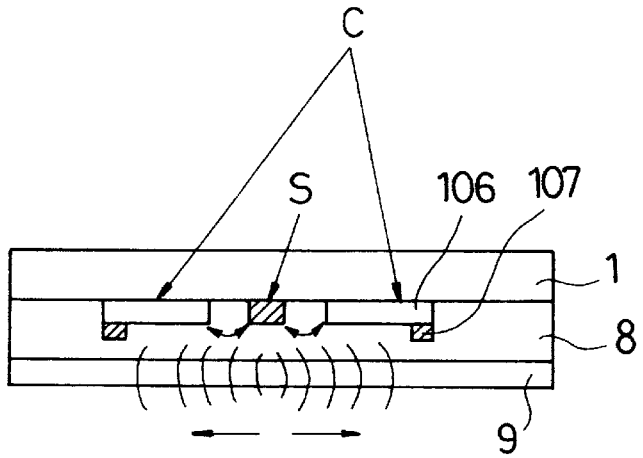
FIG. 6 is a cross-sectional view illustrating an electrode according to the present invention.
Figure 7:
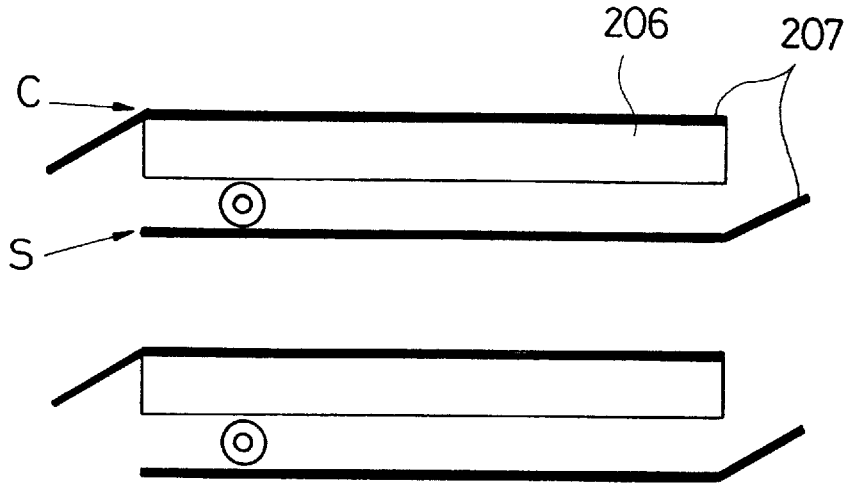
FIG. 7 is a plan view illustrating an electrode according to a second embodiment of the present invention.

FIG. 5 is a plan view illustrating a structure of an electrode according to a first embodiment of the present invention, FIG. 6 is a cross-sectional view illustrating an electrode according to the present invention, and FIG. 7 is a plan view illustrating an electrode according to a second embodiment of the present invention.

As shown in FIG. 5, the structure of the discharge sustaining electrode for a PDP according to a first embodiment of the present invention will be explained.

In the discharge sustaining electrode, three electrodes form a pair of discharges at each discharge cell.

Namely, a metallic BUS electrode 107 is installed at the center portion and performs a role of the scan electrode S, and a common electrode C formed of the BUS electrode 107 and a transparent conductive ITO electrode 106 is installed at both sides of the same, respectively.

Since the scan electrode S positioned at the center portion and formed of the BUS electrode 107 has a decreased area of the electrode, and the capacitance is decreased in proportion to the decreased area, so that at an initial discharge time, an addressing speed between the address electrode A and the scanning electrode S is increased for thereby implementing a high speed driving operation.

At this time, the charges particles are stuck on the common electrode C, so that-a certain initial address discharge is implemented using a low discharge voltage without an erroneous discharge with another electrode of a neighboring cell.

During the sustaining discharge of the scan electrode S, the discharge is performed based on two common electrodes C, the amount of the visual ray is increased due to the optical duplicate phenomenon, so that it is possible to enhance the luminance of a corresponding pixel.

Figure 8:
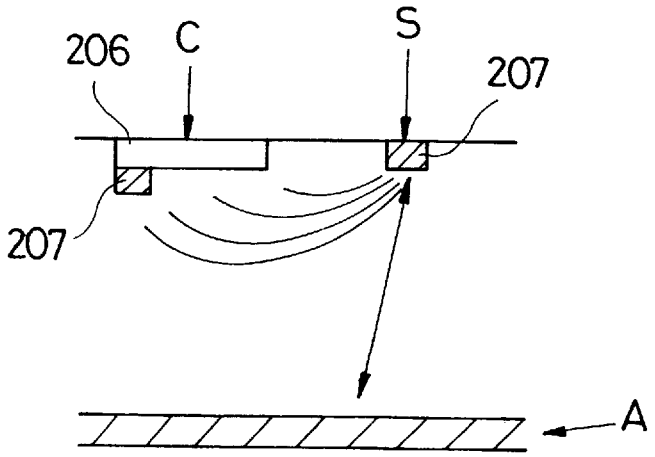
FIG. 8 is a cross-sectional view illustrating an electrode according to a second embodiment of the present invention.

In addition, as shown in FIGS. 7 and 8, the discharge sustaining electrode according to a second embodiment of the present invention, two electrodes C and S form a pair of discharges at each discharge cell. The scan electrode S is formed of a metallic bus electrode 207.

Namely, the scan electrode S is implemented using a bus electrode 207 which has a small area of electrode, so that the capacitance is minimized, and the discharge speed is increased during the address discharge with the address electrode A.

As the electrode area of the scan electrode S, namely, the electrode width is decreased, the distance between the neighboring cells is relatively increased, so that an erroneous discharge with other electrodes is prevented, and the number of the pixels(discharge cells) which are implemented by the area unit is increased for implementing a high resolution.

Figure 9:
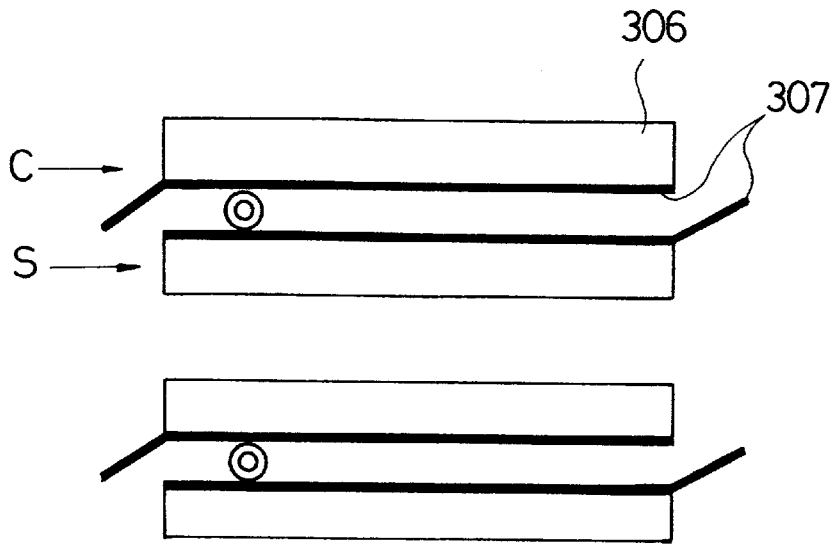
FIG. 9 is a plan view illustrating an electrode according to the present invention.
Figure 10:
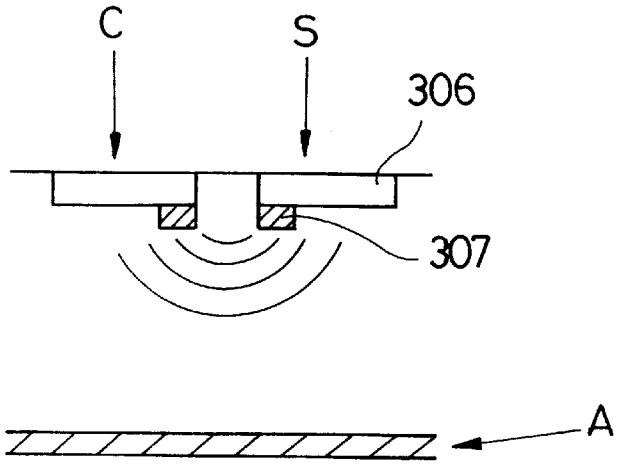
FIG. 10 is a cross-sectional view illustrating an electrode according to a third embodiment of the present invention.

As shown in FIGS. 9 and 10, the sustaining electrode according to a third embodiment of the present invention is formed of a pair of electrodes C and S at each discharge cell, and the scan electrode S and the common electrode C each are formed of an ITO electrode 306 and a BUS electrode 307.

At this time, the BUS electrode 307 formed of a low resistance material is formed at the shortest distance between the electrodes along the inner side opposite to the ITO electrode 306 differently from the conventional art. Therefore, a discharge is fast implemented between the scan electrode S and the common electrode C when a discharge sustaining voltage is applied.

When a voltage is applied to the common electrode C for sustaining a light emitting operation of the cells based on an address discharge between the scan electrode S and the address electrode A, so that it is possible to implement a short time discharge between the scan electrode S and the common electrode C and a stable luminance and a lot amount of charged particles.

In addition, since the metallic bus electrode 307 is installed at the center of the discharge cells, so that the luminance characteristic may be degraded. However, since the decrease of the luminance characteristic is too small to affect the total luminance increase, the entire luminance is increased.

As the start time of the sustaining discharge is shortened, it is possible to implement a high resolution, and since the discharge start voltage is decreased under the same condition, it is possible to implement a power saving effect.

Figure 3:
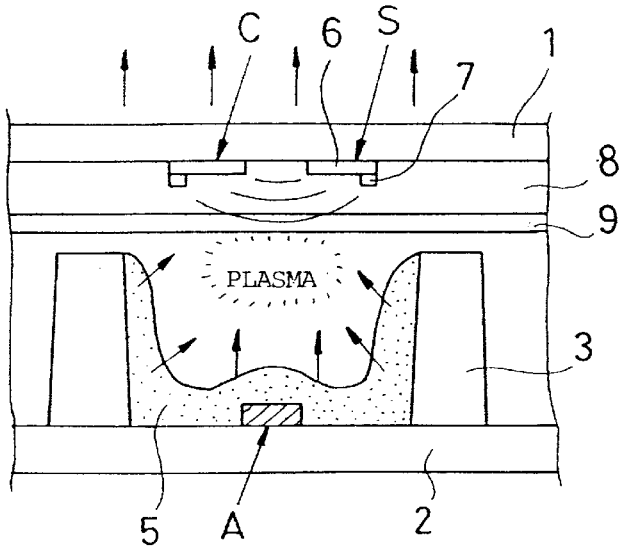
FIG. 3 is a cross-sectional view illustrating a pixel of a panel in the conventional art.
Figure 4:
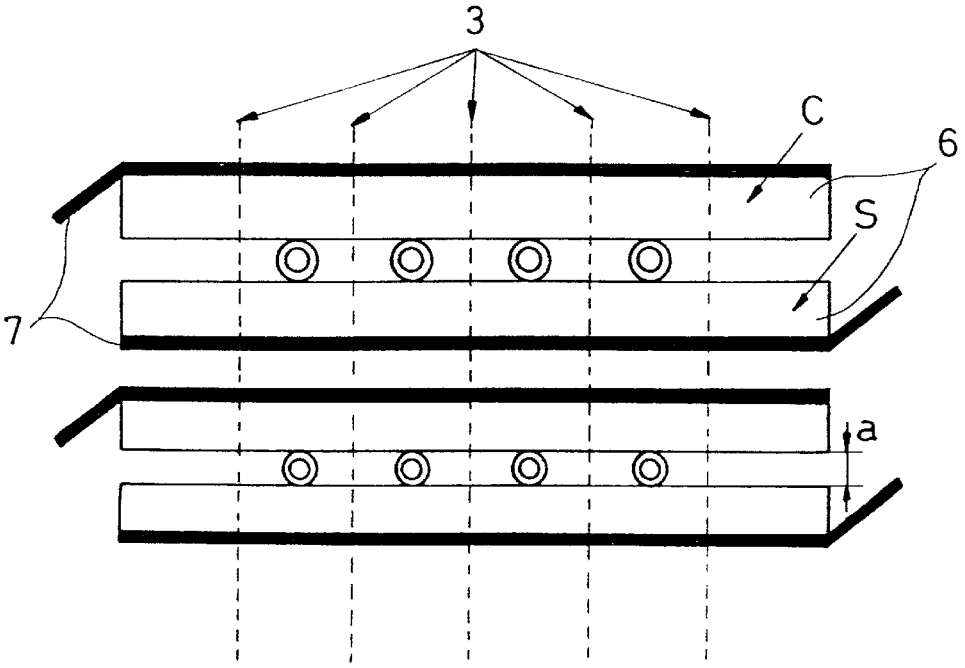
FIG. 4 is a plan view illustrating a structure of a conventional discharge sustaining electrode.

Comparing the conventional sustaining electrode structure as shown in FIGS. 3 and 4 and the discharge sustaining electrode structure according to the present invention as shown in FIGS. 5 through 10, in the conventional art, the discharge start speed and the transient time to the sustaining discharge take long time at the initial address discharge at a corresponding discharge pixel, so that the image display is too slow, and an erroneous discharge may occur between the neighboring electrodes. However, in the present invention, the capacitance of the electrode is decreased, and the discharge characteristic between the sustaining discharge electrode is improved, and the entire image display time is shortened.

Therefore, in the discharge sustaining electrode according to the present invention, the erroneous discharge based on the discharge between the electrodes is prevented, and a stable operation of the PDP is implemented.

As described above, since -the initial address discharge time between the sustain electrode and the address electrode at a discharge pixel and the sustaining discharge time between the sustaining electrode and the common electrode are significantly decreased for thereby implementing a certain image display resolution and preventing an erroneous discharge.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A PDP (Plasma Display Panel) including:

two engage substrates having a discharge space therebetween;

a discharge sustaining electrode arranged on one side of the substrates for forming a plurality of discharge pairs; and an address electrode arranged on the other side of the substrates for forming a discharge pixel at a portion in which the discharge sustaining electrode and the address electrode are crossed, wherein the discharge sustaining electrode comprises:

three electrodes at each pixel in the discharge sustaining electrode, wherein the three electrodes comprise a scan electrode installed between a pair of common electrodes.

2. The structure of claim 1, wherein each of said common electrodes is formed of a transparent conductive material ITO electrode and a metallic BUS electrode.

3. The structure of claim 1, wherein said scan electrode is formed of a metallic BUS electrode.

4. The structure of claim 1, wherein both ends of each of the common electrodes are connected to each other.

5. A PDP (Plasma Display Panel), comprising:

two engaged substrates engaged for forming a discharge space for a plurality of pixels therebetween; and a discharge sustaining electrode arranged on one side of one of the substrates wherein the discharge sustaining electrode comprises a scan electrode with a BUS electrode, and a common electrode at each pixel, wherein the discharge space is located between the BUS electrode of the scan electrode and the common electrode.

6. The structure of claim 5, wherein said common electrode includes:

a transparent conductive material ITO electrode; and a metallic BUS electrode, and wherein said scan electrode consists of a metallic material.

7. A PDP (Plasma Display Panel), comprising:

two engaged substrates which form a discharge space therebetween; and a discharge sustaining electrode set arranged on one side of one of the substrates, wherein the discharge sustaining electrode set comprises a scan electrode with a BUS electrode, and a common electrode with a BUS electrode, wherein the discharge space is formed between the BUS electrode of the scan electrode and the BUS electrode of the common electrode.

8. A PDP (Plasma Display Panel), comprising:

an upper substrate;

a lower substrate spaced apart from the upper substrate forming discharge spaces between the lower and upper substrates; and a plurality of sets of electrodes on the upper substrate, wherein each set of electrodes comprises a scan electrode with a scan metallic BUS electrode, and a common electrode, wherein each discharge space is formed directly between the scan metallic BUS electrode and the common electrode of each set.

9. The structure of claim 8, wherein each set of electrodes further comprises an address electrode on the lower substrate and wherein each set of electrodes comprises a pixel.

10. The structure of claim 9, wherein a discharge of a pixel of the PDP comprises discharge between the common electrode, the address electrode and the scan metallic BUS electrode of a set of electrodes.

11. The structure of claim 8, wherein each common electrode comprises a transparent conductive material ITO electrode and a metallic BUS electrode.

12. The structure of claim 11, wherein the discharge spaces are formed directly between the scan metallic BUS electrode and the common ITO electrode.

13. The structure of claim 12, wherein in each set of electrodes the common metallic BUS electrode is formed on the common ITO electrode along an edge of the common ITO electrode farthest away from the scan electrode.

14. The structure of claim 8, wherein in each set of electrodes each scan electrode is centered between a pair of common electrodes.

15. The structure of claim 14, wherein one end of each of the pair of common electrodes are connected to each other.

16. The structure of claim 14, wherein each of said pair of common electrodes comprises a transparent conductive material ITO electrode and a metallic BUS electrode and wherein the discharge spaces are formed directly between the scan metallic BUS electrode and the common ITO electrodes.

17. The structure of claim 8, wherein the common electrode comprises a common transparent ITO electrode and a common metallic BUS electrode, and wherein the scan electrode further comprises a scan transparent ITO electrode.

18. The structure of claim 17, wherein the common metallic BUS electrode is formed on the common ITO electrode along an edge of the common ITO electrode.

19. The structure of claim 18, wherein the discharge spaces are formed between the scan BUS electrode and the common BUS electrode.

20. The structure of claim 18, wherein the discharge spaces are formed adjacent to the scan BUS electrode and the common electrode.

* * * * *